US012650278B1

(12) United States Patent
Vester, Jr.

(10) Patent No.: US 12,650,278 B1
(45) Date of Patent: Jun. 9, 2026

(54) FIREARM SLING CONNECTOR WITH A MOUNT ASSEMBLY AND ONE OR MORE LOOPS

(71) Applicant: Samuel Draper Vester, Jr., Laredo, TX (US)

(72) Inventor: Samuel Draper Vester, Jr., Laredo, TX (US)

( * ) Notice: Subject to any disclaimer, the term of this patent is extended or adjusted under 35 U.S.C. 154(b) by 0 days.

(21) Appl. No.: 18/975,353

(22) Filed: Dec. 10, 2024

(51) Int. Cl.
*F41C 23/02* (2006.01)

(52) U.S. Cl.
CPC ..... *F41C 23/02* (2013.01)

(58) Field of Classification Search
CPC ..... F41C 23/02; F41C 27/00
See application file for complete search history.

(56) References Cited

U.S. PATENT DOCUMENTS 2,440,012 A * 4/1948 Haver ..... G09F 3/0352 24/30.5 R
2,763,082 A * 9/1956 Sprague ..... F41C 23/02 42/85
4,982,522 A * 1/1991 Norton ..... F41C 33/00 224/220
5,093,964 A * 3/1992 Rowland ..... B65H 75/366 24/17 AP
D376,473 S * 12/1996 Franks ..... D3/262
6,749,099 B2 * 6/2004 Danielson ..... A45F 5/021 226/149
7,043,862 B2 * 5/2006 Franks ..... F41C 33/08 42/94
7,219,398 B1 * 5/2007 Hunt ..... F16G 11/00 24/265 AL
9,157,700 B1 * 10/2015 Hansen ..... F41C 23/02
9,528,795 B1 * 12/2016 Burnsed, Jr. ..... F41C 23/02
10,281,235 B1 * 5/2019 White ..... F41C 33/00
2012/0193378 A1 * 8/2012 Schroedel, Jr. ..... F41C 23/02 224/150
2013/0333168 A1 * 12/2013 Burnsed, Jr. ..... F41C 23/02 24/573.11
2015/0128469 A1 * 5/2015 Mossie ..... F41C 23/02 42/90
2016/0195361 A1 * 7/2016 Barnett ..... F41G 11/003 42/90
2017/0314888 A1 * 11/2017 Beck ..... F41C 33/002
2020/0248983 A1 * 8/2020 Bergman ..... F41C 23/02
2021/0148672 A1 * 5/2021 Cooper ..... F41C 23/02

* cited by examiner

*Primary Examiner* — Joshua E Freeman
(74) *Attorney, Agent, or Firm* — AVEK IP, LLC

(57) ABSTRACT

A firearm accessory connector includes a mount assembly having a first side and a second side to secure together via one or more fasteners; a flexible member extending from a first end to a second end, the flexible member secured to the mount assembly such that a loop is formed by the flexible member; the flexible member and the mount assembly are to secure an accessory to a firearm.

19 Claims, 12 Drawing Sheets

FIREARM SLING CONNECTOR WITH A MOUNT ASSEMBLY AND ONE OR MORE LOOPS

BACKGROUND

1. Field

Embodiments of the disclosure relate to firearm accessory connector systems, and in particular, to a firearm sling connector having a mount assembly with one or more loops extending therefrom, wherein features and components of the firearm sling connector aid in noise reduction during use.

2. Related Art

Firearm accessories and connector systems, and in particular, firearm sling connectors, are well known in the art and provide for a means to connect slings (or other accessories) to firearms. Specifically, these connectors generally include a mount configured to secure the connector to the firearm, such as through conventional and known mechanisms, and a loop or similar device for attaching to a sling. Connecting a sling to a firearm is a common practice that allows for the firearm to more easily be carried on a person or stored using a sling.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

In embodiments, the disclosure relates to a firearm accessory connector, including a mount assembly having a first side and a second side configured to secure together via one or more fasteners; and a flexible member extending from a first end to a second end, the flexible member secured to the mount assembly such that a loop is formed by the flexible member; wherein the flexible member and the mount assembly are configured to secure an accessory to a firearm.

In embodiments, the disclosure also relates to a firearm accessory connector, including a mount assembly having a first side and a second side configured to secure together via one or more fasteners; a first flexible member extending from a first end to a second end, the first flexible member secured to the mount assembly such that a first loop is formed by the first flexible member; and a second flexible member extending from a first end to a second end, the second flexible member secured to the mount assembly such that a second loop is formed by the second flexible member. The first and second flexible members and the mount assembly are configured to secure an accessory to a firearm.

BRIEF DESCRIPTION OF THE DRAWING FIGURES

Embodiments of the invention are described in detail below with reference to the attached drawing figures, wherein.

Figure 1:
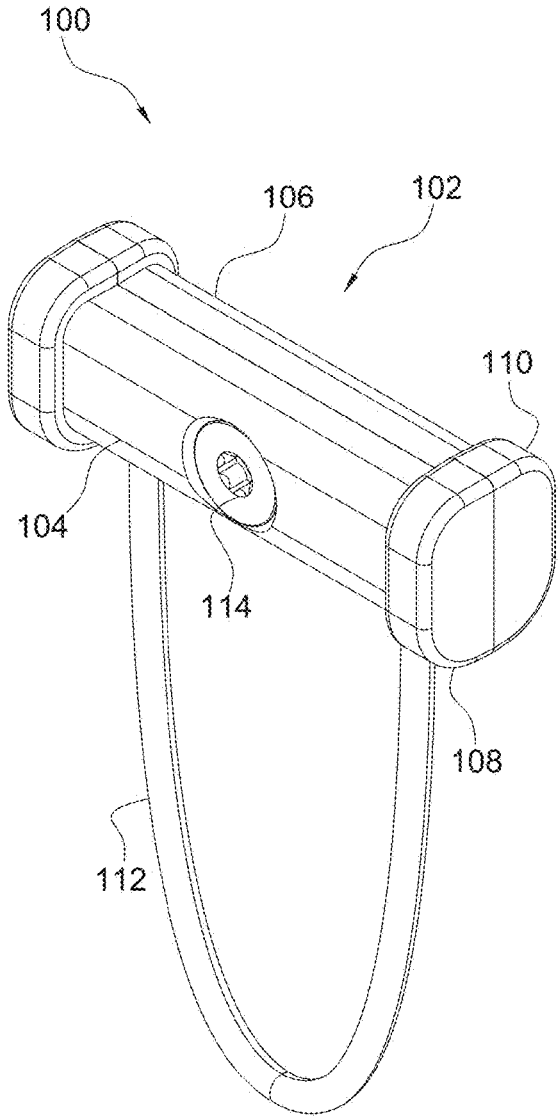
FIG. 1 is a first perspective view of a first embodiment of a firearm sling connector in accordance with the present invention.

The drawing figures do not limit the invention to the specific embodiments disclosed and described herein. The drawings are not necessarily to scale, emphasis instead being placed upon clearly illustrating the principles of the invention

LIST OF REFERENCES

100-Firearm Sling Connector
102-Mount Assembly
104-First Side of Mount Assembly
106-Second Side of Mount Assembly
108-First End Cap
110-Second End Cap
112-Flexible Member
114-Fastener

200-Fastener Aperture
300-Third End Cap
302-First End
304-Second End
306-First Stopper
308-Second Stopper
310-First Recessed Channel
312-Second Recessed Channel
314-Fastener Recessed Channel
400-Fourth End Cap
402-Third Recessed Channel
404-Fourth Recessed Channel
406-Protruding Inner Surface
600-Firearm Sling Connector
602-Mount Assembly
604-First Side of Mount Assembly
606-Second Side of Mount Assembly
608-First End Cap
610-Second End Cap
612-Flexible Member
614-First Fastener
616-Second Fastener
700-First Fastener Aperture
702-Second Fastener Aperture
800-Third End Cap
802-First End
804-Second End
806-First Stopper
808-Second Stopper
810-First Recessed Channel
812-Second Recessed Channel
814-Fastener Recessed Channel
900-Fourth End Cap
902-Third Recessed Channel
904-Fourth Recessed Channel
906-Protruding Inner Surface
1100-Firearm Sling Connector
1102-Mount Assembly
1104-First Side of Mount Assembly
1106-Second Side of Mount Assembly
1108-First End Cap
1110-Second End Cap
1112-Flexible Member
1114-First Fastener
1116-Second Fastener
1200-First Fastener Aperture
1202-Second Fastener Aperture
1300-Third End Cap
1302-First End
1304-Second End
1306-First Stopper
1308-Second Stopper
1310-First Recessed Channel
1312-Second Recessed Channel
1314-Fastener Recessed Channel
1400-Fourth End Cap
1402-Protruding Inner Surface
1500-Firearm Sling Connector
1502-Mount Assembly
1504-First Side of Mount Assembly
1506-Second Side of Mount Assembly
1508-First Flexible Member
1510-Second Flexible Member
1512-Fastener Aperture
1700-First End of First Flexible Member
1702-Second End of First Flexible Member
1704-First Stopper
1706-Second Stopper
1708-First Clip
1710-Second Clip
1712-First End of Second Flexible Member
1714-Second End of Second Flexible Member
1716-Third Stopper
1718-Fourth Stopper
1720-Third Clip
1722-Fourth Clip
1724-Protruding Inner Surface
1800-Recessed Surface
1802-Fastener Protrusion

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of the equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

As discussed above, firearm accessories and connector systems, and specifically firearm sling connectors, are well known in the art. Firearm sling connectors generally include metal or other hard material components, wherein movement of such components may result in damage to either the firearm or the hardware and unwanted noise. Noise reduction is particularly important in various uses of firearms, including both defense and sports usages of firearms. For example, in a defense situation, it may be critical that the firearm user remain as inconspicuous as possible. Similarly, in a sport situation, such as hunting, it is also important that the user remains discreet. Accordingly, it is the primary object of the present invention to provide a firearm sling connector with a mount assembly and one or more flexible members specifically configured to aid in noise reduction during use.

In embodiments, the present invention includes a mount assembly having end caps composed of a shock absorbing material, such as rubber or foam, that, should the end cap(s) hit against a surface, limited noise is emitted. In addition, the present invention utilizes one or more flexible members, each forming a loop, wherein the one or more flexible members are preferably composed of an inner flexible member with an outer coating, wherein the outer coating is composed of a polymer, plastic, or carbon wrap such that the coating again aids in reducing noise associated with impact of the flexible member against a surface. Yet further, the one or more flexible members are preferably secured to the mount assembly via stoppers, wherein the stoppers ensure a tight and secure fit of the ends of the flexible members, thereby preventing unwanted movement and noise.

Figure 2:
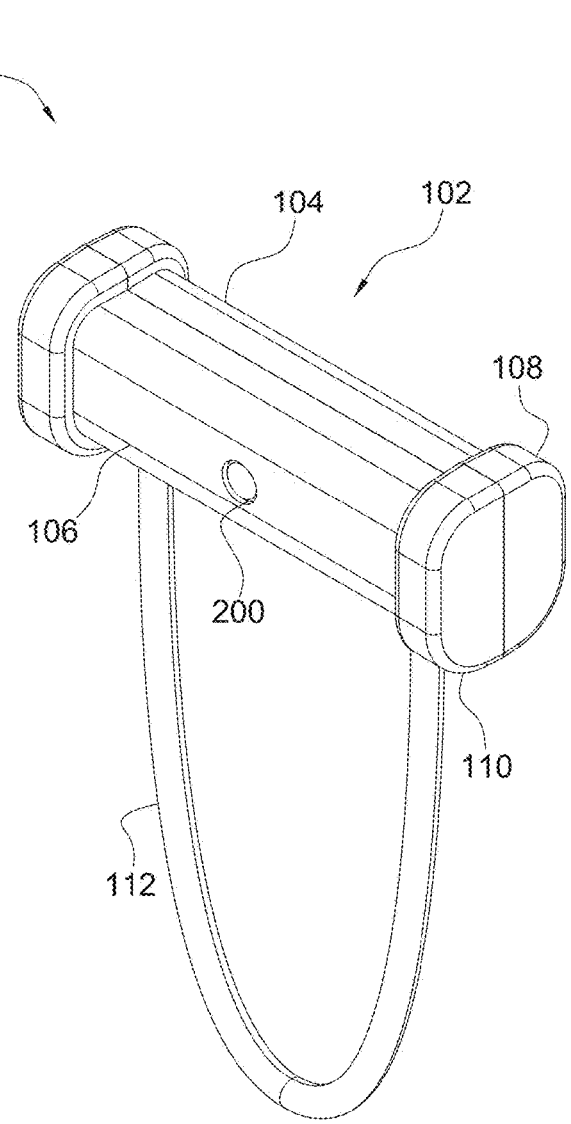
FIG. 2 is a second perspective view of the first embodiment of the firearm sling connector.

Turning now to FIGS. 1 and 2, a first embodiment of a firearm sling connector 100 is shown. Firearm sling connector 100 includes a mount assembly 102 which is elongated and formed via a first side 104 and a second side 106. The sides 104, 106 are substantially equal in dimensions and therefore are configured to come together to form the mount assembly 102. Each side 104, 106 includes associated end caps 108, 110 which are composed of a shock absorbing material, such as plastics, rubbers, foam, or other suitable materials as would be understood by those skilled in the art. As shown, end caps 108, 110 fully cover the ends of associated sides 104, 106 such that the sides themselves, or at least the ends, will generally not come into contact with a surface. This configuration aids in noise reduction during use and further aids in preventing damage to a firearm. In this first embodiment, a single fastener 114 extends through the sides 104, 106 via a fastener aperture 200 to secure the sides 104, 106 together. The fastener 114 may be any device suitable, such as a bolt, screw, or other similar fastening devices as would be understood by those skilled in the art. As discussed in more detail below, the firearm connector may be modified with a plurality of fasteners, or through dimensional changes, such that the present invention can be adapted for use with varying firearms and slings.

A flexible member 112 extends from a first end to a second end, the ends being positioned and secured between sides 104, 106 such that a loop is formed as shown. The flexible member 112 is configured to secure to a mount on a firearm to therefore secure connector 100 to a firearm. The flexible member 112, in embodiments, is composed of an inner flexible member and an outer coating. The inner flexible member, though able to vary, may be composed of a steel cable, and the outer coating may be composed of a polymer, plastic, or carbon wrap. This again helps provide noise damping properties of connector 100 as the outer coating will absorb shock and therefore noise.

Figure 3:
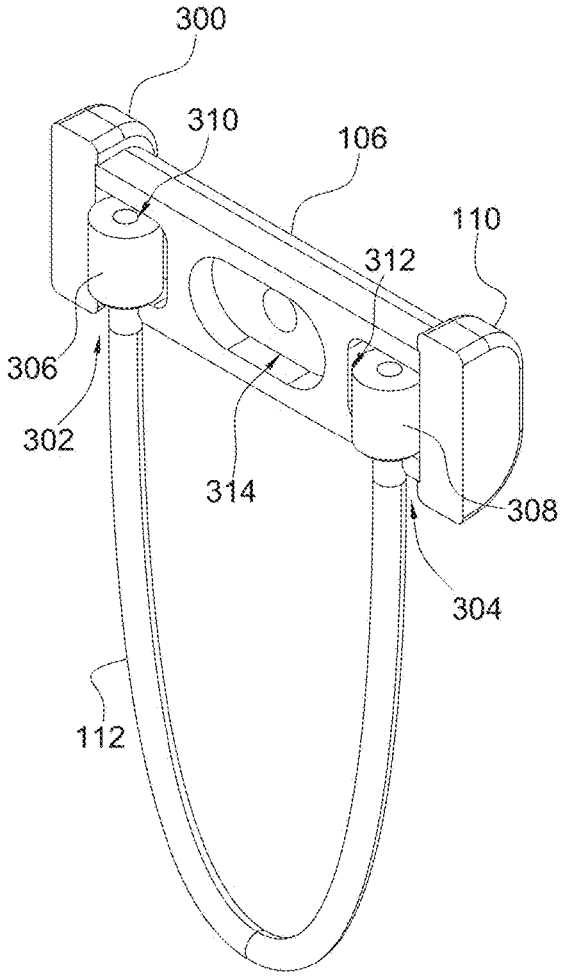
FIG. 3 is a perspective view of a second side of a mount assembly of the first embodiment of the firearm sling connector.
Figure 4:
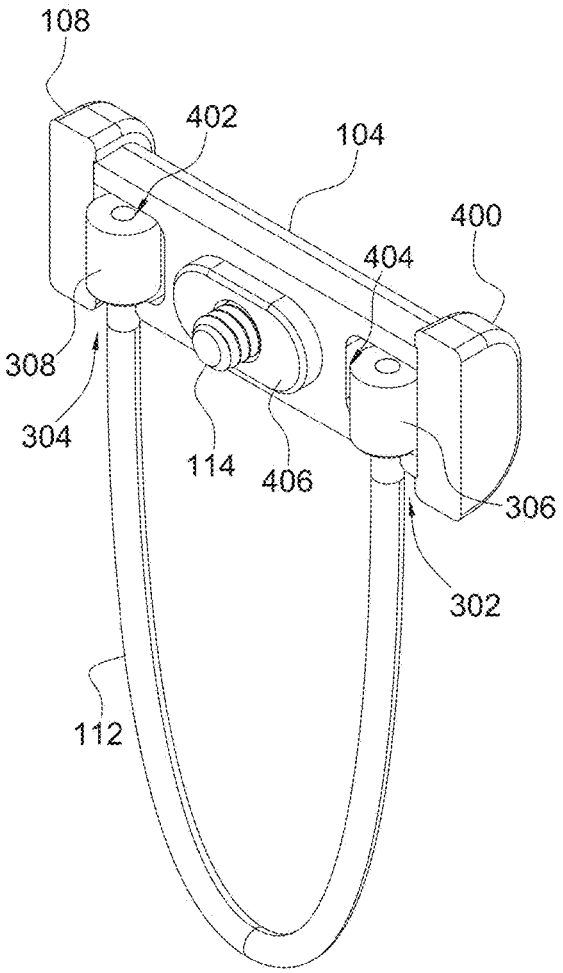
FIG. 4 is a perspective view of a first side of the mount assembly of the first embodiment of the firearm sling connector.
Figure 5:
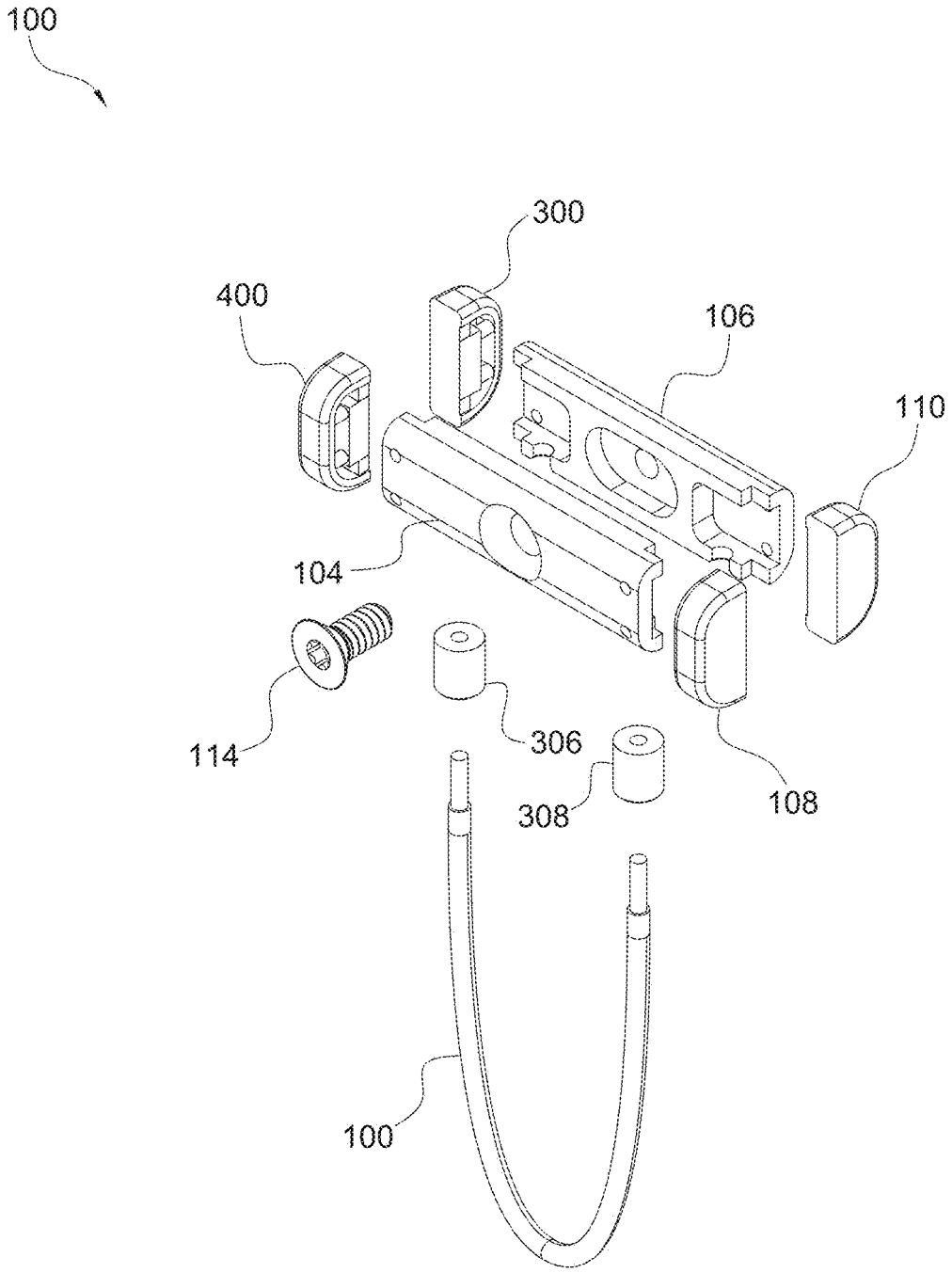
FIG. 5 is an exploded view of the first embodiment of the firearm sling connector.

FIGS. 3, 4, and 5 depict the internal components of connector 100 and the assembly therewith. In FIG. 3, second side 106 is shown having a third end cap 300 again fully covering the associated end of side 106. Flexible member 112 extends from the first end 302 to the second end 304, wherein the ends 302, 304 are secured within first and second stoppers 306, 308. Stoppers 306, 308 are then embedded within first and second recessed channels 310, 312. The stoppers 306, 308 ensure a tight fit for ends 302, 304 and are preferably composed of aluminum or copper. Side 106 includes a fastener recessed channel 314 configured to engage with a protruding surface 406 of side 104. This nesting between sides 104, 106 ensures proper fit once sides 104, 106 are fully secured together.

As shown in FIG. 4, side 104 also includes a fourth end cap 400 and corresponding third and fourth recessed channels 402, 404 to further receive stoppers 306, 308 when the mount assembly 102 is secured together.

During construction of the firearm sling connector 100, stoppers 306, 308 and flexible member 112 are securely embedded into one side of mount assembly 102 and then the second side of mount assembly 102 can be used to sandwich stoppers 306, 308 and flexible member 112 therebetween. After fastener 114 is added, flexible member 112 is fully and securely retained. Fastener 114 is such that an end user can easily disassemble and assemble connector 100 for installation or as needed.

During use, flexible member 112 engages with a mount on a firearm, thereby presenting mount assembly 102 for engagement with a sling or other firearm accessory. In other words, flexible member 112 mounts to an aperture or opening on a firearm mount, thereby presenting mount assembly 102 for a sling to secure therearound.

Turning now to FIGS. 6 through 10, a second embodiment of a firearm sling connector 600 is shown. Those skilled in the art will appreciate that the features of the various embodiments can be interchanged. Firearm sling connector 600 includes a mount assembly 602 having a first side 604 and a second side 606 secured together. A flexible member 612 forms a loop as the first end and the second end engage with mount assembly 602. In this embodiment, two fastener apertures 700, 702 provide for receiving fasteners 614, 616 such that sides 604, 606 are secured together via multiple fasteners. Those skilled in the art will appreciate that additional fasteners may be utilized without departing from the present invention. Also shown in this embodiment are end caps 608, 610, which are composed of a shock absorbing material, such as rubber, plastic, or foam and secure over the ends of sides 604, 606. This ensures that if sling connector 600 is bumped into a structure, end caps 604, 606 aid in reducing the noise of impact.

Figure 8:
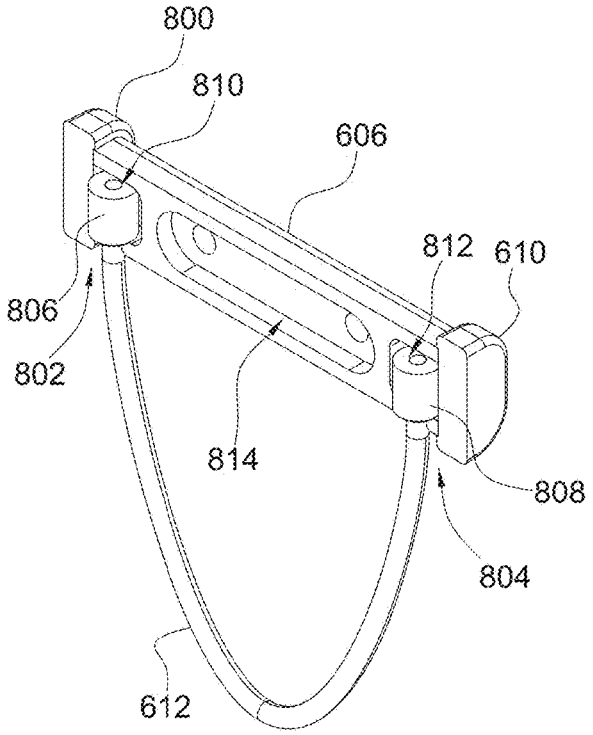
FIG. 8 is a perspective view of a second side of a mount assembly of the second embodiment of the firearm sling connector.
Figure 9:
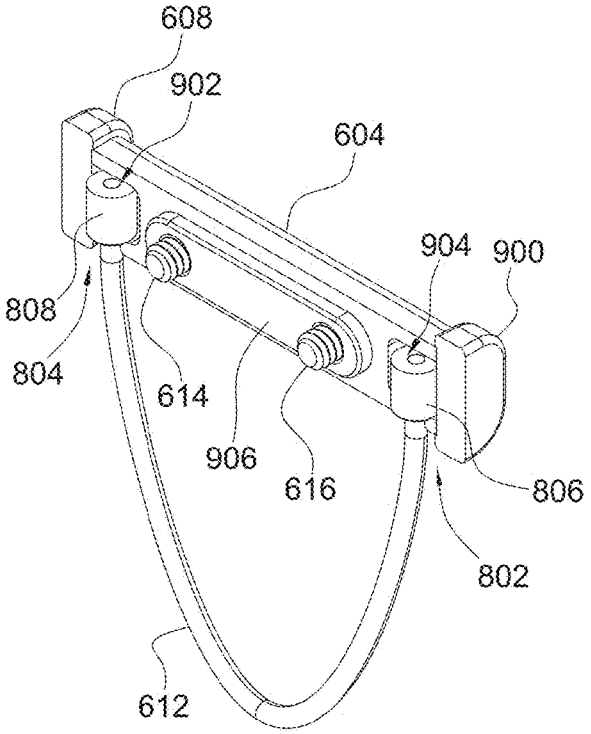
FIG. 9 is a perspective view of a first side of the mount assembly of the second embodiment of the firearm sling connector.
Figure 10:
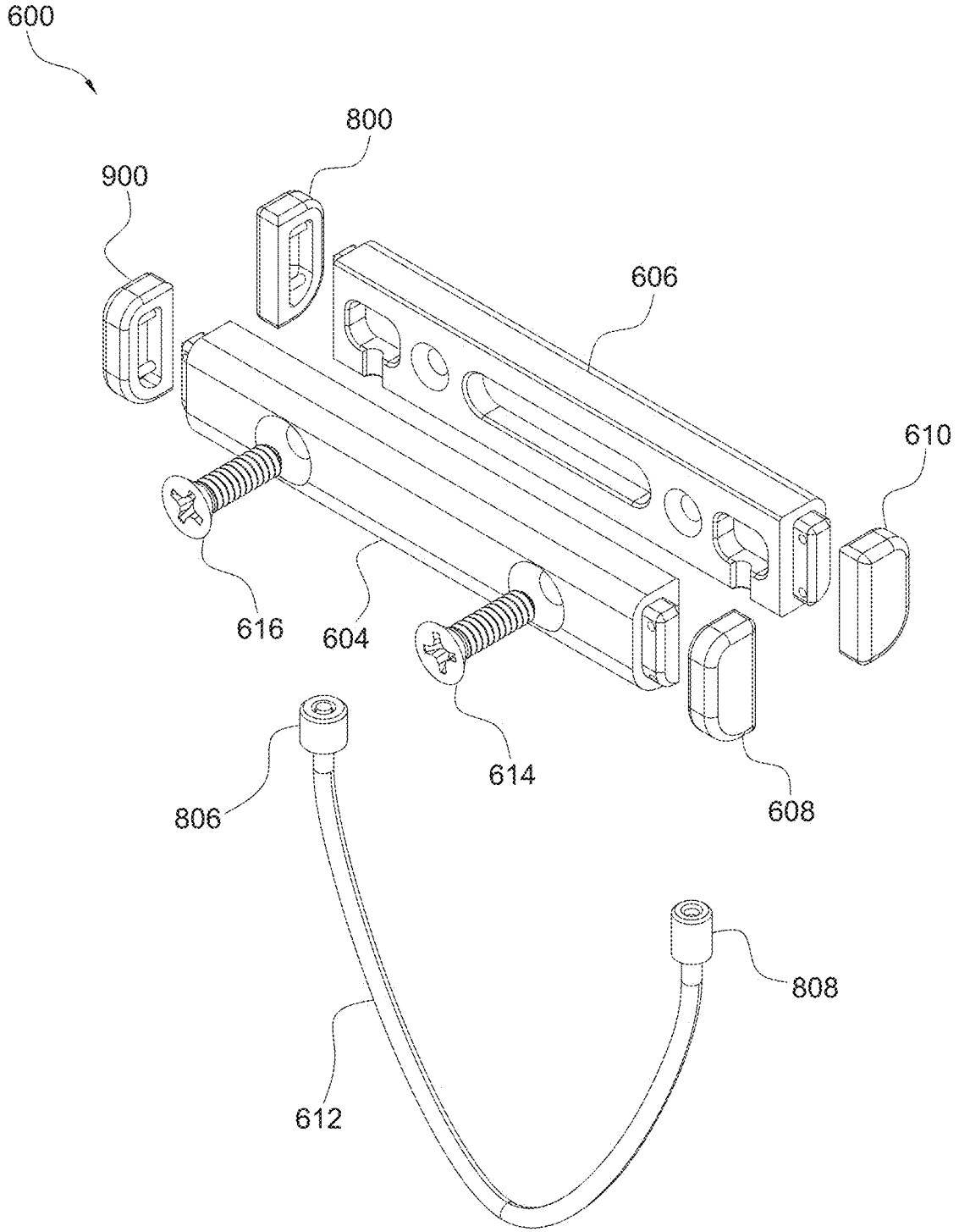
FIG. 10 is an exploded view of the second embodiment of the firearm sling connector.
Figure 11:
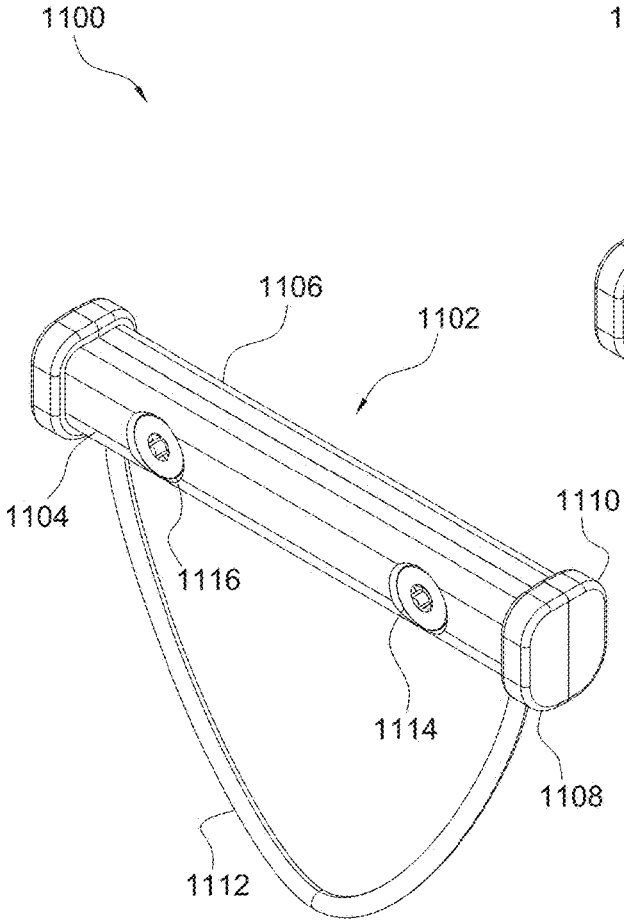
FIG. 11 is a first perspective view of a third embodiment of a firearm sling connector in accordance with the present invention.
Figure 12:
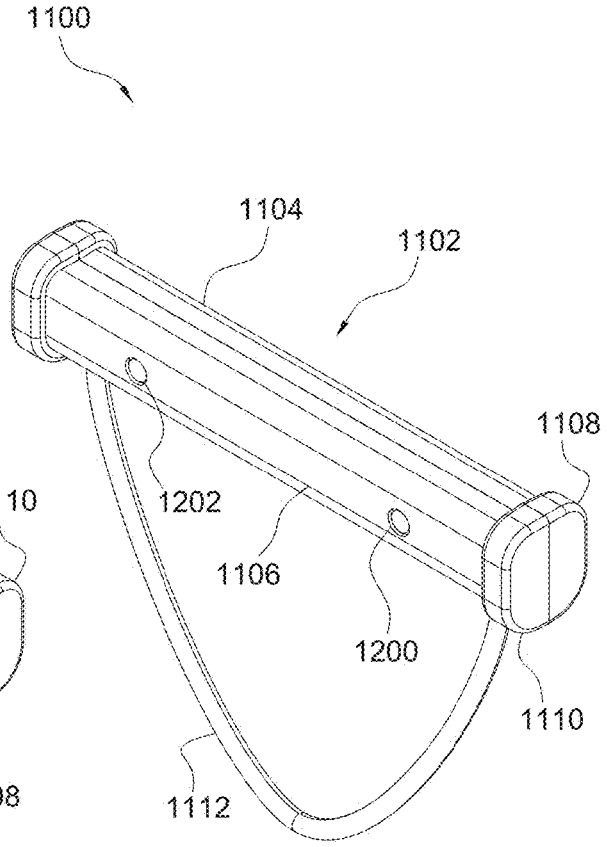
FIG. 12 is a second perspective view of the third embodiment of the firearm sling connector.

FIGS. 8 and 9 depict the internal components of connector 600. Second side 606 includes a third end cap 800 such that both ends of side 606 are fully encapsulated and enclosed. Flexible member 612 extends from a first end 802 to a second end 804, wherein ends 802, 804 are secured within stoppers 806, 808 and then retained within recessed channels 810, 812. A fastener recessed channel 814 is also provided for engagement with a protruding inner surface 906 of first side 604. First side 604 also includes a fourth end cap 900, as well as third and fourth recessed channels 902, 904 for coupling with stoppers 806, 808. Connector 600 secures together the same as connector 100, wherein channels 810, 812 align with channels 902, 904, and recess 814 aligns with protruding inner surface 906, thereby creating a nesting function between each side.

Figure 6:
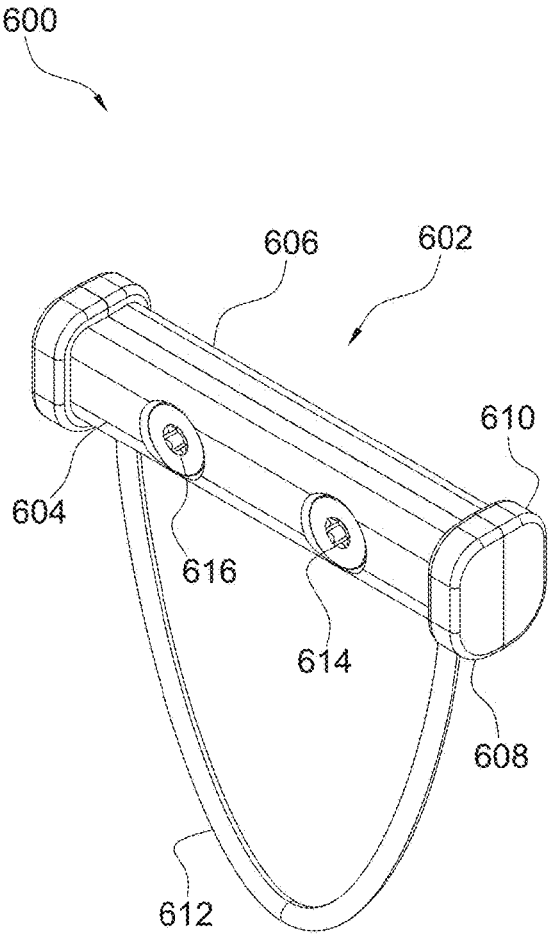
FIG. 6 is a first perspective view of a second embodiment of a firearm sling connector in accordance with the present invention.
Figure 7:
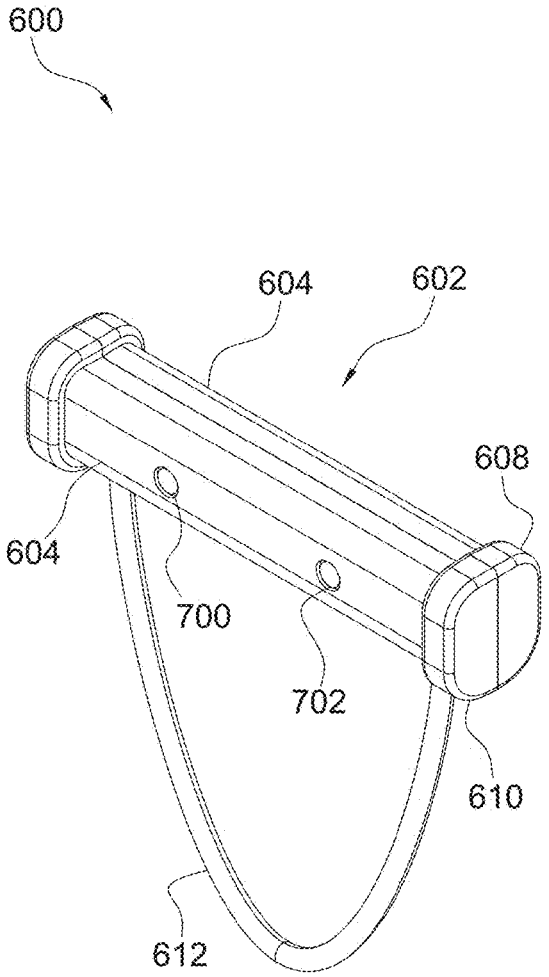
FIG. 7 is a second perspective view of the second embodiment of the firearm sling connector.

In FIGS. 11 through 14 another embodiment of a firearm sling connector 1100 is shown, which is substantially similar to the second embodiment (as shown in FIG. 6). This embodiment demonstrates that the overall dimensions of the firearm sling connector can vary, such as would be appropriate depending on a firearm and style of sling for which the connector is intended to be used with.

Those skilled in the art will appreciate that the features of the various embodiments can be interchanged. Firearm sling connector 1100 includes a mount assembly 1102 having a first side 1104 and a second side 1106 secured together. A flexible member 1112 forms a loop as the first end and the second end engage with mount assembly 1102. In this embodiment, two fastener apertures 1202, 1200 provides for receiving fasteners 1114, 1116 such that sides 1104, 1106 are secured together. Also shown in this embodiment are end caps 1108, 1110, which are composed of a shock absorbing material, such as rubber, plastic, or foam and secure over the ends of sides 1104, 1106. This ensures that if the sling connector 1100 is bumped into a structure, end caps 1108, 1110 aid in reducing the noise of impact.

Figure 13:
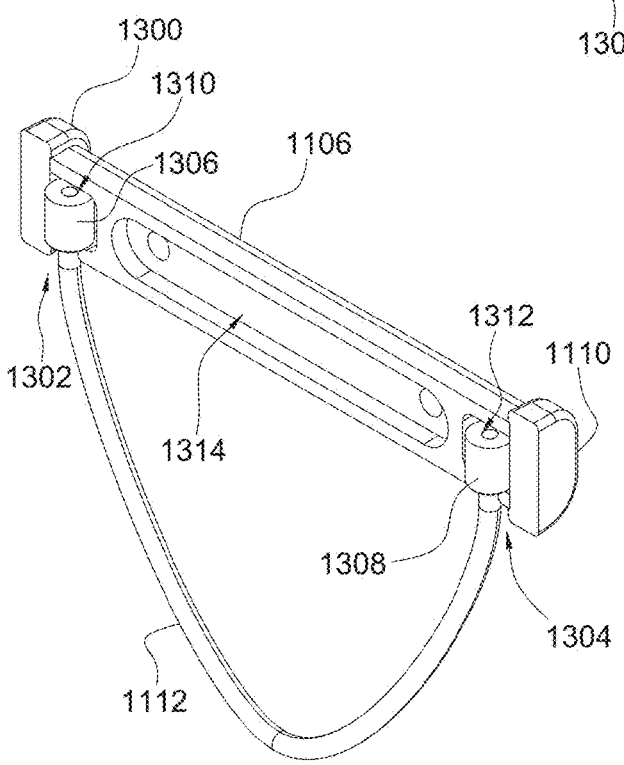
FIG. 13 is a perspective view of a second side of a mount assembly of the third embodiment of the firearm sling connector.
Figure 14:
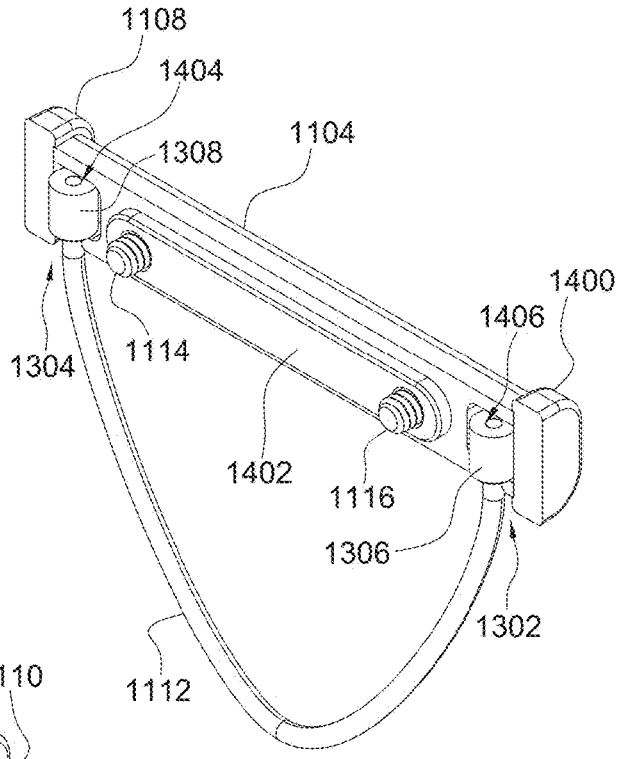
FIG. 14 is a perspective view of a first side of the mount assembly of the third embodiment of the firearm sling connector.
Figure 15:
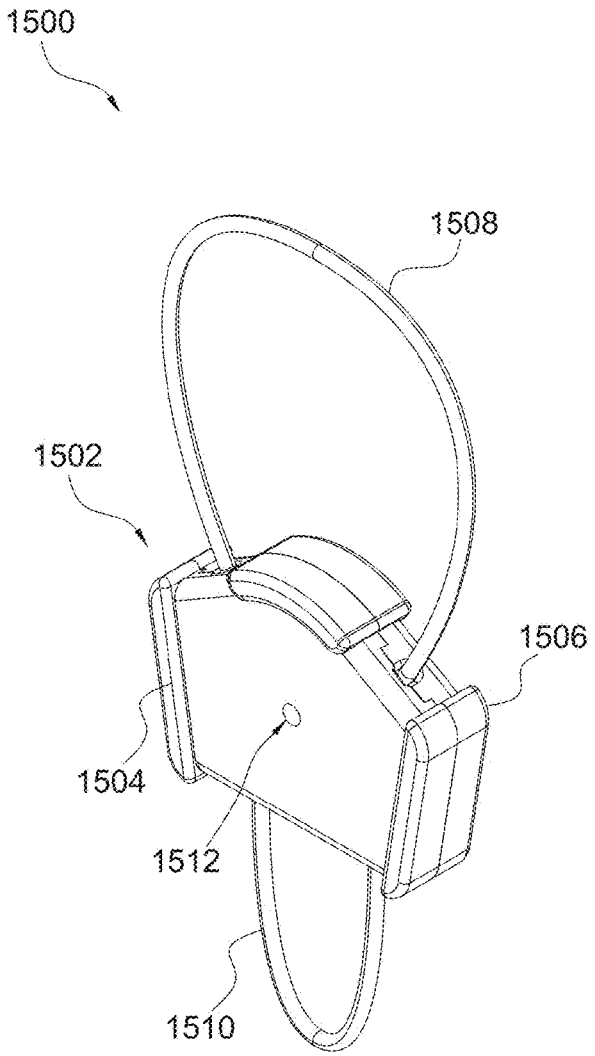
FIG. 15 is a first perspective view of a fourth embodiment of a firearm sling connector in accordance with the present invention.
Figure 16:
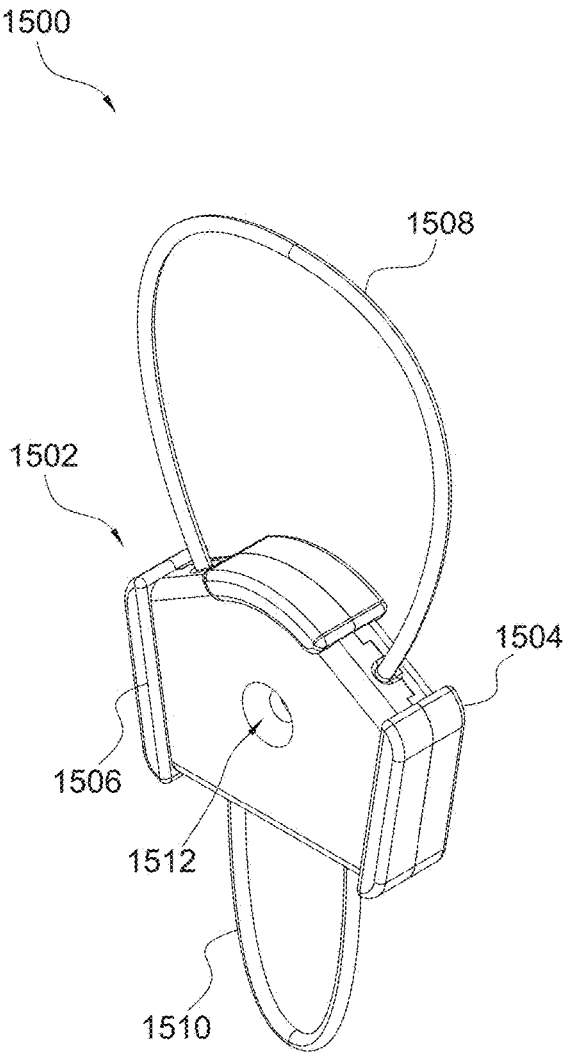
FIG. 16 is a second perspective view of the fourth embodiment of the firearm sling connector.

FIGS. 13 and 14 depict the internal components of connector 1100. Second side 1106 includes a third end cap 1300. The flexible member 1112 extends from a first end 1302 to a second end 1304, wherein ends 1302, 1304 are secured within stoppers 1306, 1308 and then retained within recessed channels 1310, 1312. A fastener recessed channel 1314 is also provided for engagement with a protruding inner surface 1402 of first side 1104. First side 1104 also includes a fourth end cap 1400, as well as third and fourth recessed channels 1404, 1406 for coupling with stoppers 1306, 1308.

In FIGS. 15 through 18, a double loop version of a firearm sling connector 1500 is shown. Connector 1500 includes a mount assembly 1502 again including a first side 1504 and a second side 1506 configured to secure together. Connector 1500 also includes a first flexible member 1508 and a second flexible member 1510, each forming a loop as shown. In embodiments, the loops specifically extend in opposite directions as shown. Accordingly, mount assembly 1502 is designed such that each can extend from an opposite side. A fastener aperture 1512 allows for a fastener (e.g. bolts and screws) to secure sides 1504, 1506 together. It is contemplated that additional fasteners may be utilized.

Figure 17:
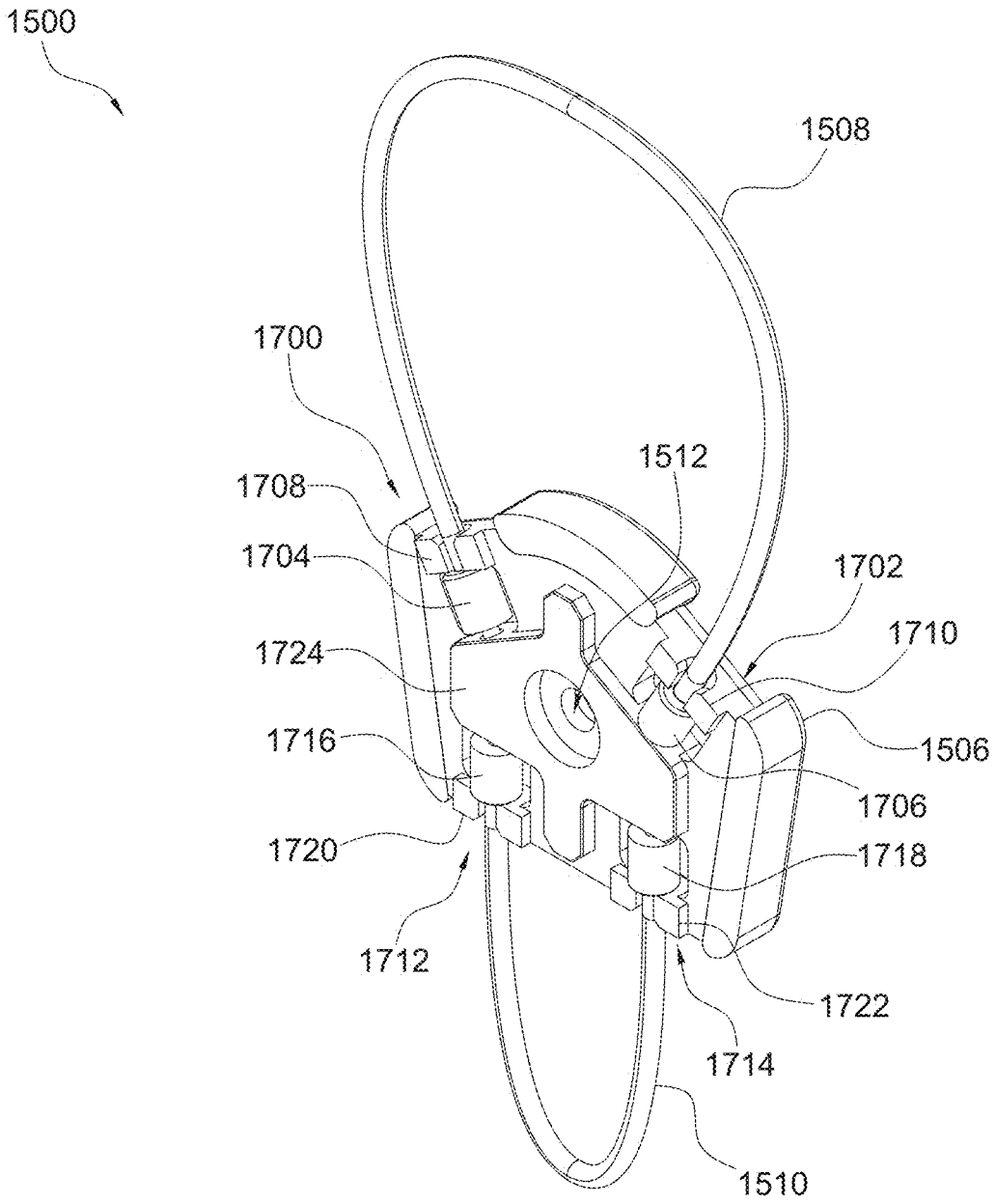
FIG. 17 is a perspective view of a second side of a mount assembly of the fourth embodiment of the firearm sling connector.
Figure 18:
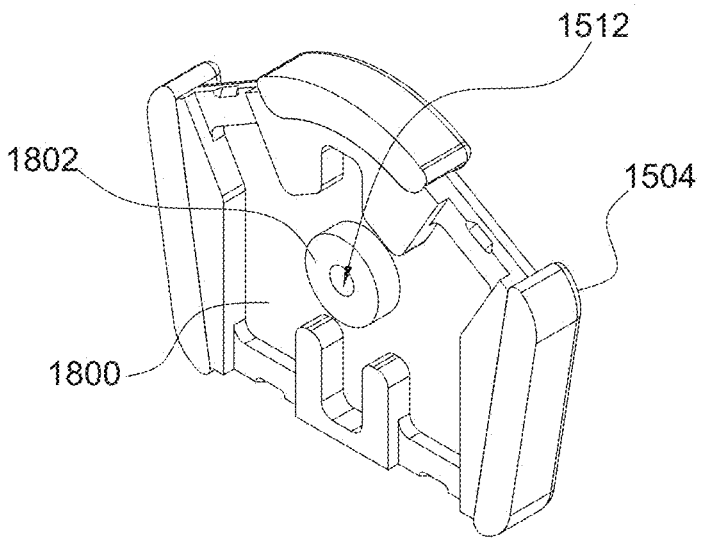
FIG. 18 is a perspective view of a first side of the mount assembly of the fourth embodiment of the firearm sling connector.

Turning to FIG. 17, the internal components of connector 1500 are shown. First flexible member 1508 extends from a first end 1700 to a second end 1702, wherein each end is further secured within a stopper 1704, 1706. In this embodiment, stoppers 1704, 1706 are retained within mount assembly 1502 via clips 1708, 1710 which create an opening smaller than stoppers 1704, 1706, thereby preventing stoppers 1704, 1706 from being removed once sides 1504, 1506 are secured together. Clips 1708, 1710 may be merely appropriately sized openings, or may have tension/spring retention.

Similarly, second flexible member 1510 extends from a first end 1712 to a second end 1714 and again, ends 1712, 1714 are secured and retained via stoppers 1716, 1718. Clips 1720, 1722 are further utilized to retain flexible member 1510 with stoppers 1716, 1718 within mount assembly 1502. As shown with FIGS. 17 and 18, the sides of mount assembly 1502 include a corresponding protruding inner surface 1724 and recessed surface 1800 for nesting together when connector 1500 is fully assembled. This ensures a tight fit without movement once secured. Side 1504 further includes a fastener protrusion 1802.

Again, those skilled in the art will appreciate that the features of each embodiment can be applied to alternate embodiments without departing from the intended invention herein.

Figure 19:
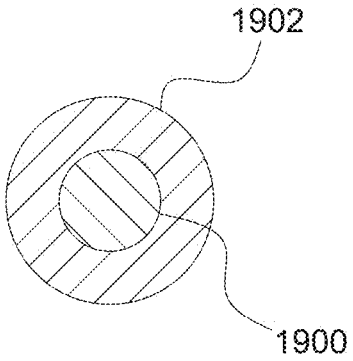
FIG. 19 is a cross-sectional view of a flexible member applicable to any of the embodiments of the firearm sling connector in accordance with the present invention.

In FIG. 19, a cross-sectional view depicts a flexible member having an inner flexible member 1900 and an outer coating 1902. As discussed above, the inner flexible member 1900 may be any suitable material, such as steel cable, while the outer coating 1902 is composed of a polymer, plastic, or carbon wrap.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A firearm accessory connector, comprising:

a mount assembly having a first side and a second side;

a flexible member extending from a first end to a second end, the flexible member secured to the mount assembly such that a loop is formed by the flexible member;

a first channel disposed between the first side and the second side and retaining the first end of the flexible member therein;

a second channel disposed between the first side and the second side and retaining the second end of the flexible member therein;

a first stopper surrounding the first end of the flexible member and retained within the first channel; and a second stopper surrounding the second end of the flexible member and retained within the second channel;

wherein the flexible member and the mount assembly are configured to secure an accessory to a firearm.

2. The firearm accessory connector of claim 1, wherein the flexible member further comprises:

an inner flexible member extending from the first end to the second end, the first end and the second end coupled to the mount assembly; and an outer coating covering at least a portion of the inner flexible member, the outer coating configured to dampen noise associated with movement of the flexible member.

3. The firearm accessory connector of claim 2, wherein the inner flexible member is a steel cable.

4. The firearm accessory connector of claim 2, wherein the outer coating is composed of a polymer.

5. The firearm accessory of claim 1, wherein the first side of the mount assembly further comprises a protruding inner surface and the second side of the mount assembly further comprises a recessed channel, wherein the protruding inner surface and the recessed channel mate together when the first side and the second side secure together.

6. The firearm accessory of claim 1, further comprising one or more fasteners securing the first side and the second side of the mount assembly together such that the first end and the second end of the flexible member are positioned between the first side and the second side.

7. The firearm accessory of claim 1, further comprising a first end cap secured onto a first side end of the first side, the first end cap configured to provide shock absorption and reduce noise.

8. The firearm accessory of claim 7, wherein the end cap fully encloses the first side end.

9. A firearm accessory connector, comprising: a mount assembly having a first side and a second side configured to secure together via one or more fasteners; a first flexible member extending from a first end to a second end, the first flexible member secured to the mount assembly such that a first loop is formed by the first flexible member; and a second flexible member extending from a first end to a second end, the second flexible member secured to the mount assembly such that a second loop is formed by the second flexible member; wherein the first and second flexible members and the mount assembly are configured to secure an accessory to a firearm.

10. The firearm accessory connector of claim 9, wherein each of the first flexible member and the second flexible member further comprise an inner flexible member and an outer coating covering at least a portion of the inner flexible member, the outer coating configured to dampen noise.

11. The firearm accessory connector of claim 10, wherein the inner flexible member is a steel cable.

12. The firearm accessory connector of claim 11, wherein the outer coating is composed of a polymer.

13. The firearm accessory connector of claim 9, further comprising:

a first stopper secured to the first end of the first flexible member and a second stopper secured to the second end of the first flexible member; and a third stopper secured to the first end of the second flexible member and a fourth stopper secured to the second end of the second flexible member;

wherein the first, second, third, and fourth stoppers aid in retaining each associated end within the mount assembly.

14. The firearm accessory of claim 13, wherein each of the first, second, third, and fourth stoppers are composed of a rubber material.

15. The firearm accessory of claim 9, wherein the first side of the mount assembly further comprises a recessed surface and the second side of the mount assembly comprises a protruding inner surface, wherein the recessed surface and the protruding inner surface nest together when the first side of the mount assembly and the second side of the mount assembly are secured together.

16. The firearm accessory of claim 9, wherein the first loop is formed in a first direction and the second loop is formed in a second direction, wherein the first direction and the second direction are opposite one another.

17. A firearm accessory connector, comprising:

a mount assembly having a first side and a second side;

a flexible member extending from a first end to a second end, the flexible member secured to the mount assembly such that a loop is formed by the flexible member; and wherein the flexible member and the mount assembly are configured to secure an accessory to a firearm;

wherein the first side of the mount assembly further comprises a protruding inner surface and the second side of the mount assembly further comprises a recessed channel, wherein the protruding inner surface and the recessed channel mate together when the first side and the second side secure together.

18. A firearm accessory connector, comprising:

a mount assembly having a first side and a second side;

a flexible member extending from a first end to a second end, the flexible member secured to the mount assembly such that a loop is formed by the flexible member; and one or more fasteners securing the first side and the second side of the mount assembly together such that the first end and the second end of the flexible member are positioned between the first side and the second side;

wherein the flexible member and the mount assembly are configured to secure an accessory to a firearm.

19. A firearm accessory connector, comprising:

a mount assembly having a first side and a second side;

a flexible member extending from a first end to a second end, the flexible member secured to the mount assembly such that a loop is formed by the flexible member, and a first end cap secured onto a first side end of the first side, the first end cap configured to provide shock absorption and reduce noise;

wherein the flexible member and the mount assembly are configured to secure an accessory to a firearm.

* * * * *